US005149003A

United States Patent [19]

Tharp

[11] Patent Number: 5,149,003

[45] Date of Patent: Sep. 22, 1992

[54] TOILET PAPER HOLDER AND PAPER TOWEL HOLDER

[76] Inventor: Glen D. Tharp, 5433 S. Clovis Ave., Fresno, Calif. 93725

[21] Appl. No.: 760,802

[22] Filed: Sep. 13, 1991

Related U.S. Application Data

[63] Continuation of Ser. No. 568,751, Aug. 17, 1990, abandoned.

[51] Int. Cl.[5] ..... B65H 16/06

[52] U.S. Cl. ..... 242/55.2

[58] Field of Search ..... 242/55.2, 55.3, 55.53; 248/160

[56] References Cited

U.S. PATENT DOCUMENTS

| | | | |
|---|---|---|---|
| 2,091,311 | 8/1937 | Fischer | 242/55.2 |
| 3,008,659 | 11/1961 | Plotkin et al. | 242/55.2 |
| 3,138,340 | 6/1964 | Caravella | 242/55.2 |
| 3,193,230 | 7/1965 | Crankshaw | 248/160 |
| 3,319,855 | 5/1967 | Tucker et al. | 242/55.2 |
| 3,401,953 | 9/1968 | Prohl et al. | 248/160 |
| 4,105,168 | 8/1978 | Rutherford | 242/55.2 |
| 4,452,403 | 6/1984 | Arronte | 242/55.2 |
| 4,541,582 | 9/1985 | Odagawa | 242/55.2 |
| 4,732,340 | 3/1988 | Toya | 242/55.2 |
| 4,821,974 | 4/1989 | Poehlein | 242/55.2 X |
| 4,915,316 | 4/1990 | Bastian | 242/55.2 |

*Primary Examiner*—Daniel P. Stodola
*Assistant Examiner*—John P. Darling
*Attorney, Agent, or Firm*—Rhodes, Coats & Bennett

[57] ABSTRACT

A toilet paper holder includes a generally planar wall plate and a pair of side arms mounted to the wall plate in spaced relationship to one another. Each of the side arms includes a core engaging member for insertion into the center tube of a toilet paper roll. One of the side arms is fixedly secured to the wall plate. The opposite side arm is pivotally mounted so as to pivot about a substantially vertical axis. The pivotal side arm is mounted by one or more spring members having first and second ends and an axis extending perpendicular to the wall plate. The first end of the spring is secured to the side arm and the second end of the spring is secured to the wall plate. When the side arm is moved from its normal closed position to an open position, the spring member is elastically deformed. The spring member biases the pivotal side arm to the closed position.

3 Claims, 4 Drawing Sheets

TOILET PAPER HOLDER AND PAPER TOWEL HOLDER

This application is a continuation of application Ser. No. 07/568,751, filed Aug. 17, 1990, now abandoned.

BACKGROUND OF THE INVENTION

The present invention relates generally toilet paper holders and more particularly to toilet paper holders of the type having a pivotal side plate for inserting and removing a roll of toilet paper.

Conventional toilet paper holders generally include a wall plate mounted on a wall, a pair of side plates extending forwardly from the wall plate, and a compressible support tube adapted to extend through the center tube of a roll of toilet paper. The side plates are generally formed with depressions to receive the opposite ends of the support tube.

Exchanging paper rolls in this type of toilet paper holder can be a cumbersome operation. First, the support tube must be axially compressed so that the shaft and the used-up roll of toilet paper can be removed from between the side place. After removing the used-up roll, a new roll is inserted on to the shaft which must be axially compressed to reinsert the shaft and new roll into the holder.

Another commonly used toilet paper holder comprises a U-shaped bracket with a wall attaching portion and projecting arms. Instead of a support tube, the projecting arms are formed with knob-like projections that extend into the ends of the center tube of the toilet paper roll. At least one of the arms is hinged where it attaches to the wall portion. To exchange the roll of toilet paper, the hinged arm swings outwardly so that the old roll can be removed and a new one inserted. An example of this type of toilet paper holder is shown in U.S. Pat. No. 4,381,083.

While the second type of toilet paper holder makes it relatively easy to exchange a roll of toilet paper, they are typically constructed of steel and are less attractive than other types of toilet paper holders. These types of toilet paper holders are most commonly found in commercial buildings where aesthetic concerns are less a factor than in homes.

Other examples of toilet paper holders are shown in the patent to Sarro, U.S. Pat. No. 2,879,012 and White, U.S. Pat. No. 4,634,067.

SUMMARY AND OBJECTS OF THE INVENTION

The present invention is an improved toilet paper holder which is both easy to use and aesthetically pleasing. The toilet paper holder of the present invention includes a wall plate and two side arms extending perpendicularly from the wall plate. Each of the side plates includes a core engaging member adapted to fit into the center tube of a toilet paper roll to support the toilet paper roll. One of the side arms is fixedly secured to the wall plate. The opposite side arm is connected to the wall plate by springs which fit into openings formed in the back edge of the side arm. The spring allows the wall plate to pivot outwardly to exchange the toilet paper roll. The wall plate and side arms can be made out of virtually any suitable material, however, the present invention is particularly well adapted for decorative wooden toilet paper holders.

Accordingly, it is an object of the present invention to provide a toilet paper holder in which the toilet paper rolls can be easily and quickly exchanged.

Another object of the present invention is to provide a toilet paper holder which eliminates the need for a compressible support tube for supporting the toilet paper roll.

Another object of the present invention is to provide a toilet paper holder in which at least one side arm moves outwardly to exchange the toilet paper roll.

Another object of the present invention is to provide a toilet paper holder having a pivotal side arm mounted to the wall plate without hinges or other visible support structures.

Other objects and advantages of the present invention will become apparent and obvious from a study of the following description and the accompanying drawings which are merely illustrative of such invention.

DETAILED DESCRIPTION OF THE INVENTION

Figure 1:
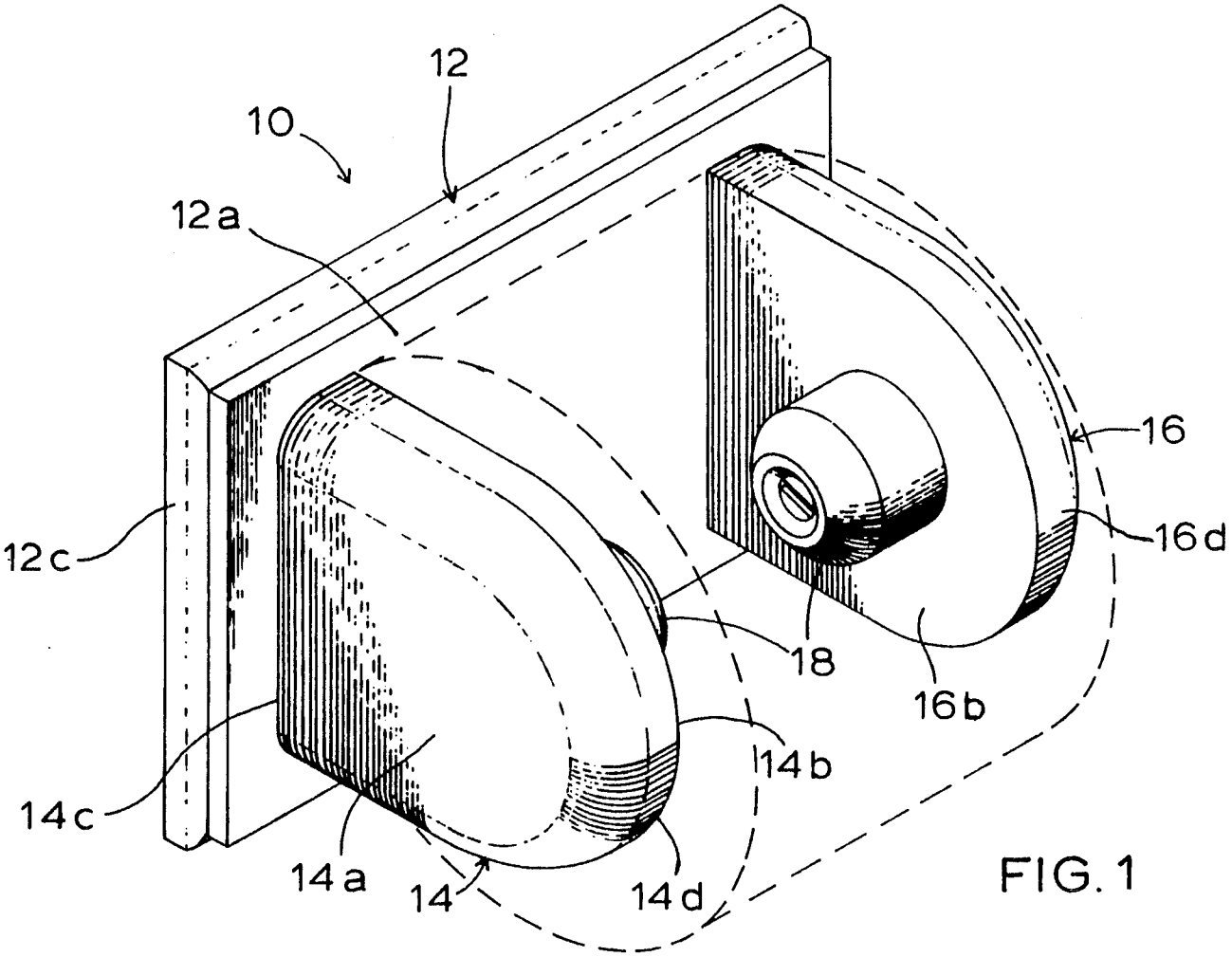
FIG. 1 is a perspective view of the toilet paper holder of the present invention.
Figure 2:
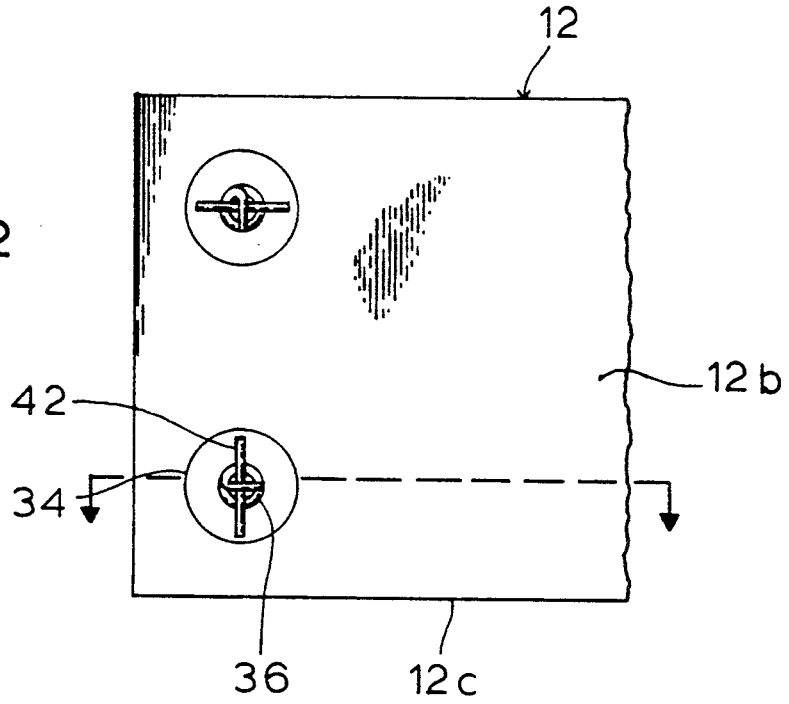
FIG. 2 is a bottom view thereof.

Referring now to FIG. 1, the toilet paper holder of the present invention is shown therein and indicated generally by the numeral 10. The toilet paper holder 10 includes a rectangular wall plate 12 and two spaced apart side arms 14 and 16. The wall plate 12 and side arms are made preferably from wood. The wall plate 12 includes a front 12*a*, a back 12*b*, and peripheral side edges 12*c*. These side arms 14 and 16 which extend perpendicularly from the wall plate 12 each include an inwardly facing surface 14 and 16*a*, an outwardly facing surface 14*a* and 16*b*, a back edge 14*c* and 16*c*, and side edges 14*d* and 16*d*. A cylindrical core engaging member 18 is attached to the inwardly facing surface of each side arm 14 and 16. The core engaging members 18 may be secured to the side arms 14 and 16 by wood screws, glue, or any other suitable means. The core engaging members 18 insert into the center tube of a toilet paper roll to support the toilet paper roll.

Figure 3:
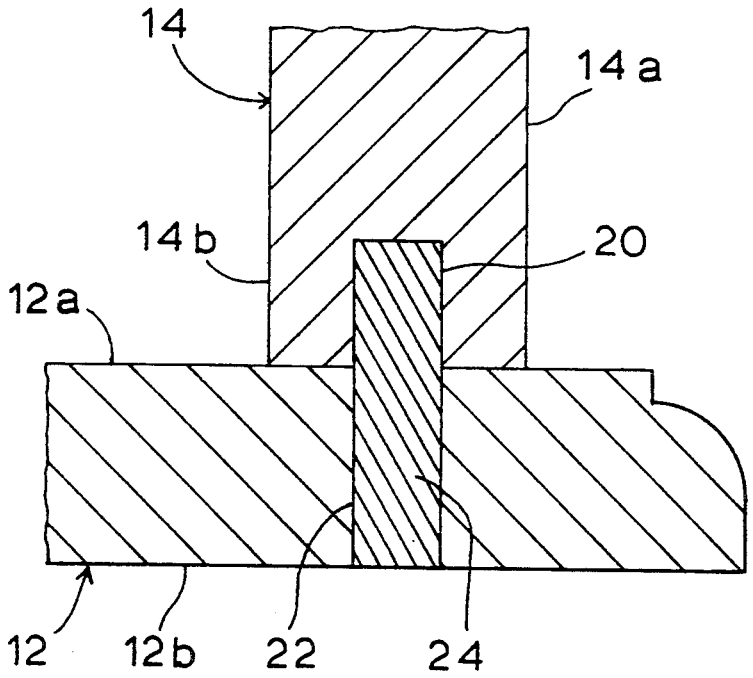
FIG. 3 is a section view showing how the fixed side arm is attached to the wall plate.

In a preferred embodiment of the invention, one of the side arms 14 is fixedly secured to the wall plate 12. The preferred method of attachment is by doweling. Referring now to FIG. 3, a first pair of dowel holes 20 are formed in the back edge 14*c* of the fixed side arm 14. A second pair of dowel holes 22 are formed in the wall member 12 in alignment with the dowel holes 20 in the side arm 14. A dowel 24 is inserted into each matching set of dowel holes 22 and 24 to secure the side arm 14 to the wall member 12.

The opposite side arm 16 is pivotally connected to the wall member 12 so as to pivot about a substantially vertical axis away from and towards the fixed side arm 14. The side arm 16 is joined to the wall member 12 by a pair of elastic members 26. The elastic members 26 extend between and interconnect the side arm 16 and the wall plate 12. More particularly, a first end of each elastic member 26 is secured to the side arm 16 while the second end of the elastic member 26 is secured to the wall plate 12. When the side arm 16 is in a normal perpendicular position, the side arm 16 is in a substantially nondeformed condition. Because the elastic members 26 resist deformation, they maintain the side arm 16 perpendicular relative to the wall plate 12.

An external force is needed to pivot the side arm 16 away from the fixed side arm 14. In pivoting the side arm 16, the outside corner 28 acts as a fulcrum or axis of rotation. When the external force is removed, the elastic members 26 return the side arm 16 to the perpendicular position.

In the preferred embodiment of the invention, the elastic members 26 comprise a pair of tension coil springs particularly adapted for use in connection with the present invention. The springs 26 fit into spring holes formed respectively in the side arm 16 and the wall member 12. A first pair of spring holes 30 are formed in the back edge 16c of the side arm 16. A second pair of spring holes 32 are formed in the wall member 12 in alignment with the first pair of spring holes 30. Counterbores 34 are formed in the back of the wall member 12 concentric with the spring holes 32.

Figure 4:
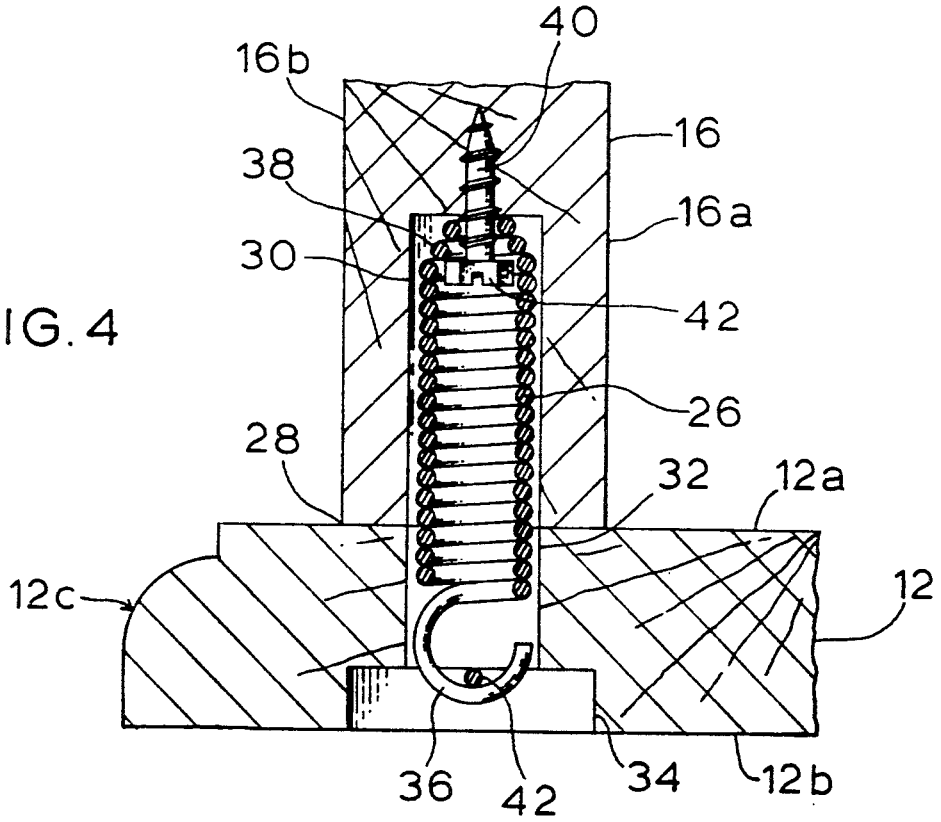
FIG. 4 is a section view taken through line X—X of FIG. 2 showing the pivotal side arm in a perpendicular position.

The counterbores 34 are larger in diameter than the spring holes 32 and define a shoulder 37 surrounding the spring holes 32. The spring has a hook 36 formed at one end. At the end opposite hook 36, the terminal coils 38 of the spring 26 get increasingly smaller and form somewhat of a cone shape 38. The cone shaped end 38 of the spring connector 30 is inserted into the spring holes 30 in the back edge of the side arm 16. A wood screw 40 extends through the coils of the spring 26 as shown in FIGS. 3 and 4 and is screwed into the material at the bottom of the hole 30. The head 42 of the screw is larger than the terminal coils 38 at the end of the spring connector so as to secure the spring to the side arm.

The hook end 36 of a spring extends into the spring hole 32 in the wall plate 12. A securing pin 42 passes through and engages the hook 36 of the spring 26. Preferably, the spring 26 should be preloaded so that the spring 26 is always in tension. Because the spring 26 normally extends along a straight line, the spring will bias the side arm 16 to the position shown in FIG. 3.

Figure 5:
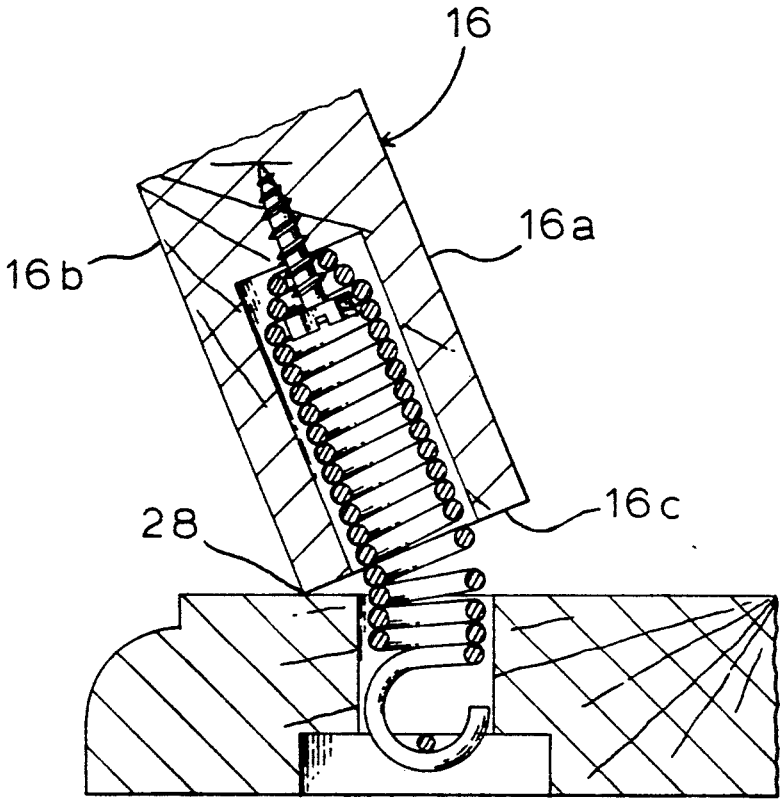
FIG. 5 is a section view taken through line X—X of FIG. 2 showing the pivotal side arm in an open position.

To insert a roll of toilet paper into the toilet paper holder, the side arm 16 is pivoted outwardly away from the fixed side arm 14 so as to bend the coil spring 26 as shown in FIG. 5. With the side arm 16 pivoted outwardly, the toilet paper roll can be inserted into the holder so that the core engaging member 18 on the fixed side arm 14 extends into the center tube of the toilet paper roll. When the toilet paper roll is properly positioned, the pivotal side arm 16 can be released and the spring 26 will return the side arm 16 to a perpendicular position.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A paper holder for holding a paper roll including a hollow core comprising:

(a) a generally planar wall plate having a front surface and a back surface for mounting on a support surface;

(b) a pair of solid side arms extending generally perpendicularly from the front surface of the wall plate, each side arm including an inwardly facing surface, an outwardly facing surface, and a back edge joining the inwardly and outwardly facing surfaces, said back edge being abutted against the front surface of the wall plate;

(c) a pair of core engaging members mounted on respective side arms for engaging opposite ends of the paper roll;

(d) means for pivotally mounting at least one of said side arms so as to pivot about an axis parallel to the wall plate between a normal engaged position with respect to said paper roll and a disengaged position, said mounting means including a coil spring for biasing said pivotable side arm to an engaged position while allowing pivotal movement of said side arm to a disengaged position, said coil spring being perpendicular to said axis;

(e) a bore formed in the back edge of said pivotable side arm for receiving a first end of said coil spring;

(f) means for securing said first end of said coil spring in said bore;

(g) a spring hole formed in said wall plate and extending from the front surface into the plate; and (h) means for anchoring said second end of said coil spring in said second spring hole.

2. The paper holder according to claim 1 wherein said anchoring means includes a recessed shoulder extending around the second spring hole adjacent the back of the wall plate, a securing pin having a length longer than the diameter of the second spring hole so that the ends of the securing pin engage the recessed shoulder on opposite sides of the second spring hole, and hook means formed on the second end of the coil spring for engaging the securing pin.

3. The toilet paper holder according to claim 1 wherein said coil spring has a tapered end including one or more terminal coils of increasingly similar diameter, and wherein said securing means comprises a screw insertable into said coil spring and having a head sized to engage the terminal coils of the coil spring.

* * * * *